US006621466B2

(12) United States Patent
Kuck

(10) Patent No.: US 6,621,466 B2
(45) Date of Patent: Sep. 16, 2003

(54) MULTIPLE BAND SPLIT GROUND PLANE ANTENNA ASSEMBLY

(75) Inventor: Richard T. Kuck, San Jose, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/039,375

(22) Filed: Jan. 3, 2002

(65) Prior Publication Data

US 2002/0190913 A1 Dec. 19, 2002

(51) Int. Cl.[7] ..... H01Q 1/48; H01Q 1/24

(52) U.S. Cl. ..... 343/846; 343/712

(58) Field of Search ..... 343/700 MS, 702, 343/846, 848

(56) References Cited

U.S. PATENT DOCUMENTS

| | | | | |
|---|---|---|---|---|
| 5,703,600 A | * | 12/1997 | Burrell et al. | 343/700 MS |
| 5,801,660 A | * | 9/1998 | Ohtsuka et al. | 343/700 MS |
| 6,271,794 B1 | * | 8/2001 | Geeraert | 343/700 MS |
| 6,300,908 B1 | * | 10/2001 | Jecko et al. | 343/700 MS |

* cited by examiner

*Primary Examiner*—Hoang Nguyen
(74) *Attorney, Agent, or Firm*—Fulbright & Jaworski L.L.P.

(57) ABSTRACT

The present invention involves and encompasses an antenna assembly having an inventive ground plane design susceptible of a variety of implementations in the field of compact wireless communication device (WCD) component design. The present invention is directed to a family of antenna assemblies that effectively function within the desired bandwidth and gain of known, prior art antenna assemblies having a larger, single surface ground plane. The modified ground plane includes a first and second conductive portion adjacent to each other in a non-conducting relation yet operatively electrically coupled to each other by at least one electrically conducting element. The resulting assembled conductor has a first predetermined longitudinal dimension which has the operational characteristics of a singular planar conductor having a second predetermined longitudinal dimension which dimension includes the axial length of the electrically conducting element that electrically couples the first and second conductive portion. This feature facilitates a variety of desirable operating characteristics including providing antenna network, or impedance, matching while allowing mass production of more compact WCD designs—in keeping with the continuing trend to smaller, yet no less effective WCD operability. In one embodiment, at least a first and a second conductive portion formed on a common base member are spaced apart and electrically coupled by at least one electrically conducting element (or connecting link). The conducting element is preferably disposed upon a side of the base member but the first and second conductive portion may be disposed on opposing sides of the base member. If desired, more than two conductive portions may be electrically coupled together in accordance with the present invention using more than a single connecting link member.

18 Claims, 3 Drawing Sheets

MULTIPLE BAND SPLIT GROUND PLANE ANTENNA ASSEMBLY

FIELD OF THE INVENTION

The present invention relates to an antenna assembly suitable for wireless transmission of analog and/or digital data, and more particularly to a multiple band antenna assembly for use with wireless communication devices.

BACKGROUND OF THE INVENTION

Wireless communication devices such as cell phones, global positioning system transceivers and hand held computers are becoming an integral part of society. Aside from obvious advantages of cordless operation, one reason that such devices have become so popular, of late, is due to the trend toward smaller and more compact overall size of such devices. Where once a typical wireless communication device (WCD) evoked images of a large, heavy, bulky device with a whip antenna, today's typical wireless communication device is small, lightweight, and easily transported. As the wireless communication devices have become smaller, antennas have evolved both in terms of location and structure. There is an increasing trend away from the external antenna not only because it is subject to breakage, but also because it operates in an omni-directional manner. Antennas which generally do not have the drawbacks to the aforementioned external antenna include internal antenna assemblies. These antennas typically may include a resonator element which is electrically connected to a comparatively larger planar conductor which functions as the second half of an asymmetric dipole. The planar conductor (which may be a ground plane of a wireless device) is usually rectangle-shaped having a longitudinal dimension which establishes a principal polarization. The planar conductor may be provided by a conductive element (such as the ground plane) associated with the printed wiring board of the wireless communication device and fabricated along with the printed wiring board using conventional techniques and technologies.

There also continues to exist in the art a need for an antenna assembly which does not have protruding elements which may injure human users and/or which are inherently susceptible to damage including breakage which might render such wireless communication devices inoperable. In addition, there exists in the art a need for an antenna which directs electromagnetic waves away from a human user of wireless communication devices and has a reduced specific absorption rate (SAR) function. In keeping with the continuing trend toward smaller, efficient, yet more compact wireless communication devices, there exists in the art a need for an operable antenna assembly which is not constrained to predetermined dimensions and whose component and assembly size may be reduced, adjusted and/or selected to provide optimal operation without regard to heretofore fixed design constraints. The inventor of the present invention also recognizes the general need in the art of wireless communication device design and implementation for a suitable antenna assembly in which components are modular and/or readily interchangeable. And, there is a need for an antenna assembly which is compact, lightweight and which may be incorporated into a variety of wireless communication devices.

SUMMARY OF THE INVENTION

The present invention involves and encompasses an antenna assembly having an inventive ground plane design susceptible of a variety of implementations in the field of compact wireless communication device (WCD) component design. The present invention is directed to a family of antenna assemblies that effectively function within the desired bandwidth and gain of known, prior art antenna assemblies having a larger, single surface ground plane. The modified ground plane includes a first and second conductive portion adjacent to each other in a non-conducting relation yet operatively electrically coupled to each other by at least one electrically conducting element. The resulting assembled conductor has an effective electrical path composed of the longitudinal dimension of the first and the second conductive portion but which has electrical operational characteristics of a singular ground plane conductor. The effective electrical path includes the axial length of the electrically conducting element that electrically couples the first and second conductive portion. This feature facilitates a variety of desirable operating characteristics while allowing mass production of more compact WCD designs.

In the preferred embodiment, at least a first and a second conductive portion formed on a generally rectangular common base member has confronting edges separated from each other. In one embodiment said separation is on the order of between approximately one and six millimeters (~1.0 mm to 6.0 mm) with a preferred embodiment having a value of slightly less than about three millimeters (2.9 mm). The first and second conductive portion are electrically coupled by at least one conducing element (or connecting link) operatively connecting the first and second conductive portion together. In a preferred embodiment, the electrically conducting member commonly comprises a copper wire having an outside diameter of around 0.80 mm and formed into the shape of the letter "c." It should be noted that the particular shape of the conducting element depends somewhat upon the length of the conducting element and may take other forms, including an "S-shape," a "Z-shape," or other varieties of shapes. In this regard, one may also utilize other types of inductor links and/or capacitive elements and multiple links may be used whether or not they are identical to other of said conducting elements used in a given ground plane constructed according to the present invention. Of course, in more complex configurations, the shape of the electrically conducting, connecting link member(s) may need to be shielded or insulated so that the desired electrical pathway is not compromised. Indeed, as appreciated by those of skill in the art, and as described and taught herein, the axial length of the electrically connecting member(s) supplies a significant portion of the advantages of the present invention.

The conducting element is preferably disposed upon a side of the base member which may be a printed wiring board of the device. However, in another embodiment of the present invention, the first and second conductive portion may be disposed on opposing sides of the base member to facilitate compact construction. In addition, more than two conductive portions may be electrically coupled together in accordance with the present invention to match the impedance of the antenna and produce the frequency band-width or pattern beam-width required for quality signal characteristics.

In one form of the present invention, a substantially planar ground plane having said conductive portion(s) disposed on at least one surface thereof typically includes a resonator (which may be modular) and an optional feed line which may be operatively connected to various devices through an appropriately sized surface mount adaptor. Although the ground plane may be disposed upon a flexible, or deformable, base member other embodiments may include a non-planar assembly of printed wiring boards. In any event, the resultant split ground plane antenna assembly of the present invention is not only compact, but exhibits a desirable low specific absorption rate (SAR) function. The split ground plane has an effective electrical length (in a longitudinal dimension) substantially comprised of the length of the two separated conductive elements in addition to the effective length of the connecting element. Thus, by forming an electrical coupling between the two conductive planes an effectively increased overall ground plane is enabled within a smaller, more compact overall physical envelope.

Split ground plane antennas as disclosed, enabled, and illustrated herein function i properly using an effective conductive plane with operational characteristics typical of much larger antenna in terms of performance and overall footprint requirements. Additionally, antenna designed according to the present invention may be configured to operate in either a single band or a multiple band mode depending on the resonator element(s) associated with the antenna assembly. Finally, antenna constructed according to the present invention can comprise any number of antenna components or resonator types as would be obvious to those of skill in the art to which the present invention is directed. Indeed, those of skill in the art shall immediately recognize that a variety of types of split gap ground plane antennas result from application of the teaching herein. For example, a plurality of gap features between and among said ground plane (and related electrically conducting connector members) may be implemented including a wide variety in the number of gaps, size of the spacing of the gaps (including parallel and non-parallel spacing comprising said gap features), dimensions of the conducting connector members, and locations of said gaps are all susceptible to application of the teaching herein. Additional components such as but not limited to capacitive and/or inductive assemblies may well be employed within a connecting link to produce useful iterations of the present invention as is understood by those of skill in the art to which the invention is directed.

It is an object of the present invention to provide an antenna assembly which may be incorporated into a wireless communication device.

Another object of the present invention is to reduce the dependence of the dimensions of a ground plane on a particular wavelength or fractional portion thereof.

Another object of the present invention is to facilitate more overall compact construction in a wireless communication device.

Yet another object of the present invention is to minimize the need for an antenna matching network.

A feature of the present invention is that the combined ground plane comprises two conductive elements which are operatively connected to each other.

Another feature of the present invention is that the conductive ground plane may be operatively connected to a variety of resonator elements.

Another feature of the present invention is that fabrication may be accomplished through existing technologies and mass production techniques.

An advantage of the present invention is that the antenna assembly has a low profile which enables it to be used in small articles such as wireless communication devices.

Another advantage of the present invention is that the split conductive plane is able to operate as if it in fact comprised a traditional larger, singular conductive plane and that enables multi-band and single band frequency sensitivity and operation.

These and other objects, features and advantages will become apparent in light of the following detailed description of the preferred embodiments in connection with the drawings. Of course, as appreciated by those of skill in the art to which the present invention is directed the following detailed description and drawings are intended as illustrative and not limiting as to the scope of the present invention claimed herein, and that many variations and subtle changes may be made in designing antenna assemblies according to the teaching herein without departing from the spirit and scope of the present invention as defined in the appended claims hereto.

DETAILED DESCRIPTION OF THE PREFERRED EMBODIMENTS

Figure 1:
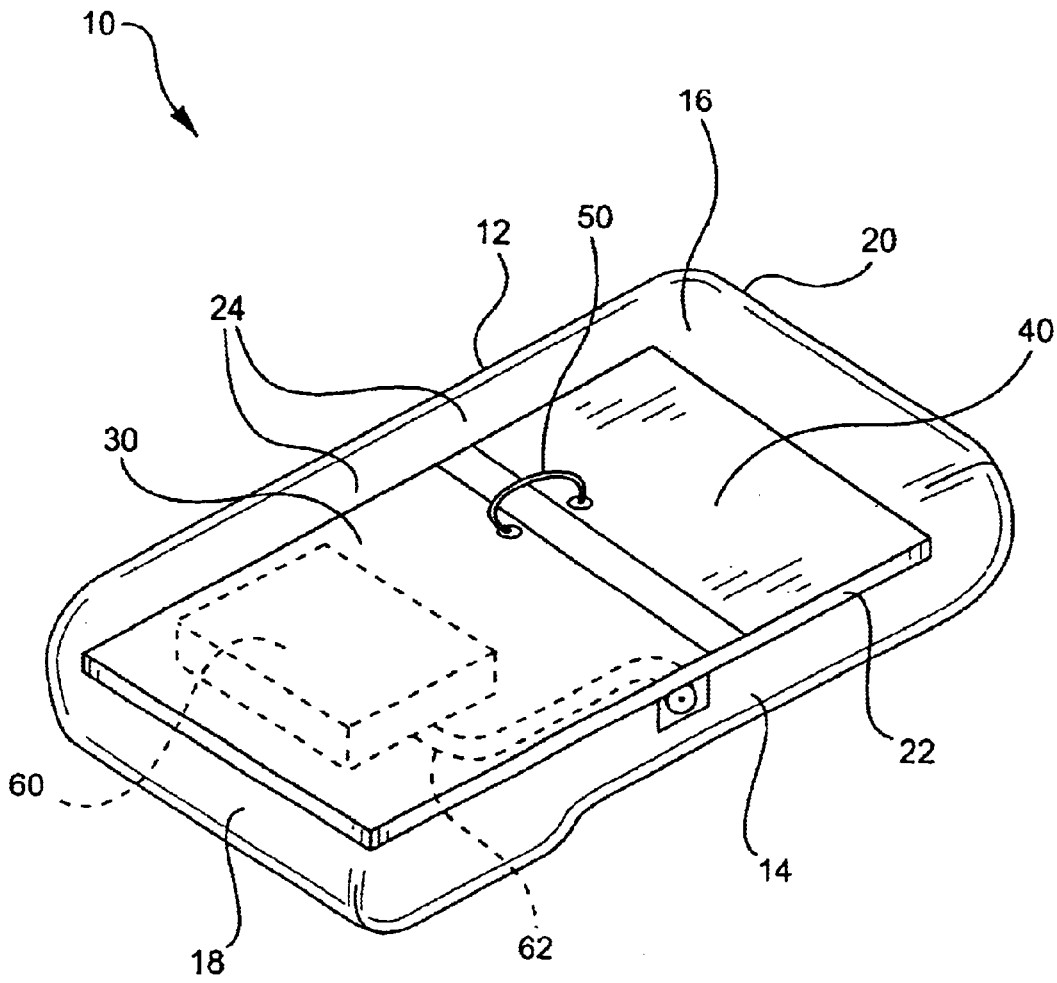
FIG. 1 is a partial, perspective view of a wireless communication device incorporating an antenna assembly comprising a resonator and a split ground plane according to the present invention.

Referring now to the drawings, wherein like numerals depict like parts throughout, FIG. 1 illustrates a wireless communication device (WCD) 10 having a housing 12 with a front 14, a rear or back 16, a top 18, a bottom 20 and a printed wiring board (PWB) 22. Typical components and other portions of the wireless communication device 10 have been omitted to illustrate the juxtaposition of the antenna assembly as it resides within the housing 12. The antenna assembly comprises a resonator element 60 (shown in phantom) and the ground plane 24 of the printed wiring board 22. The ground plane 24 includes a first conductive portion 30 and a second conductive portion 40 operatively connected to each other by a conducting element 50.

Figure 2:
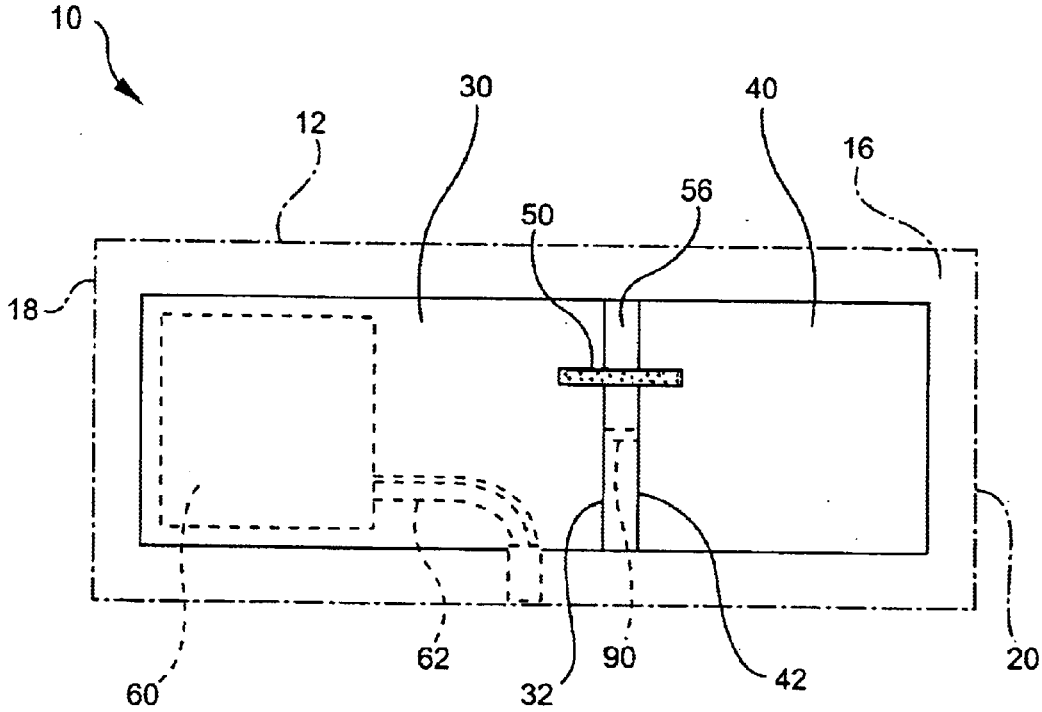
FIG. 2 is a plan view of the antenna assembly of FIG. 1 taken from the back of a wireless communication device, with the wireless communication device depicted in phantom.

Turning to FIG. 2, the first and second conductive portions 30, 40 are arranged on the printed wiring board 22 in a non-conductive relation to define a gap 56 therebetween. More specifically, in a preferred embodiment, the first and second conductive portions 30, 40 are rectangular in shape and each includes two sets of opposing edges 32, 34; 36, 38 and 42, 44; 46, 48, respectively, with the edges 32, 42 in opposing relation to each other to form the gap 56. A conducting element 50 having ends 51, 52 operatively connects the first and second conductive portions 30, 40 together at attachment points 52 and 54 (See, FIG. 3).

Preferably, the conducting element 50 is a portion of a loop of copper wire having an outer diameter of around 0.80 mm, and a length (defined by ends 51 and 53) which is dependent upon the standing-wave-ratio match. However, it is understood that other materials and configurations may be used. For example, the conducting element 50 may be formed along with the first and second conductive elements 30, 40 as an electrically conducting trace 90 (shown in phantom lines in FIG. 2). As with the wire conducting element 50, the electrically conducting trace 90 would have a predetermined length dependent upon the operational characteristics of the device. Moreover, the conducting element may take on a meander or other shape (whether or not substantially serpentine) having an effective predetermined electrical length.

Figure 3:
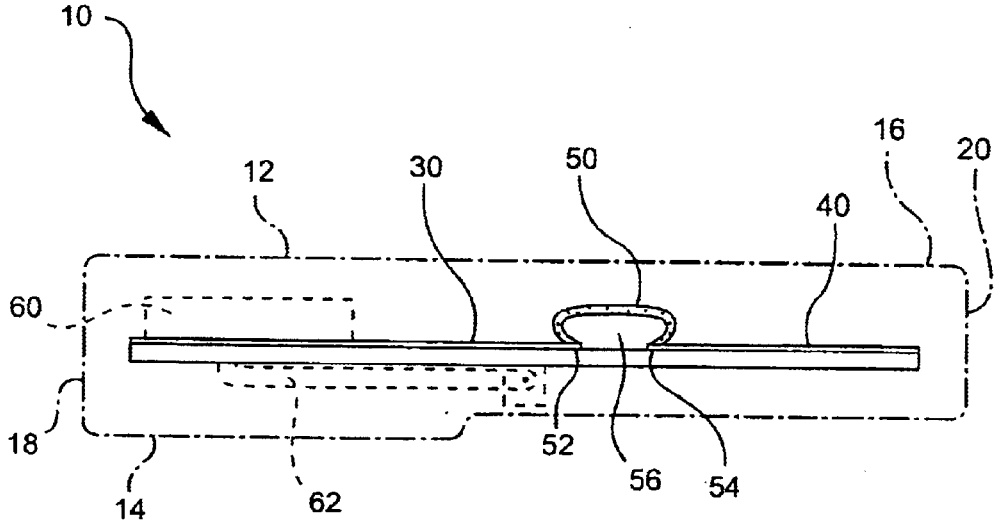
FIG. 3 is a side plan view of the antenna assembly of FIG. 1, with the wireless communication device depicted in phantom.

As depicted in FIG. 2 and FIG. 3, the first and second conductive portions 30, 40 and the conducting element 50 (and/or electrically conductive trace 50) are assembled to form a combined conductor having a first predetermined longitudinal extent, or length. This assembled combined conductor functions as a singularly formed ground plane conductor having a second predetermined longitudinal extent. In other words, by virtue of the combined lengths of its components (i.e., the length of the first conductive portions 30 taken from edge 34 to edge 32, the length of the second conductive portion 40 taken from edge 44 to edge 42, and the effective length of conducting element 50 taken from end 51 to end 53) the assembled combined conductor has the operational characteristics of a larger, ground plane conductor. For example, if the first conductive portion 30 had a length of three units, the second conductive portion had a length of 2 units and the conducting element 50 had an effective length of three units, the effective length would be approximately eight units. However, the total length of the assembled planar conductor could be substantially less than eight units. Thus, the split plane enables the printed wiring board and the wireless communication device to be more compactly formed. And, as one may appreciate, another benefit of having a multi-component planar conductor which effectively operates as a differently sized singular planar conductor is that antenna network matching is simplified.

In a preferred embodiment depicted in FIG. 3, the first conductive portion 30 can be somewhat larger than the second conductive portion 40 to facilitate mounting of the resonator 60 thereon by known techniques and technologies (not shown). Note that the resonator 60 may be single or multiple band modular unit common to the art. As mentioned previously, the resonator and ground plane may be operatively connected to a feed line 62. Preferably, the feed line 62 is a co-axial cable having an inner member and a resistance of around 50 Ohms. However, it is understood that other feed lines may be used, such as microstrip lines, serpentine electrical traces, or other electrical conduit having the appropriate nominal electrical resistance value to maintain balanced circuitry. The co-axial cable 62, when used, may be provided with a suitable surface mount adaptor (not shown) to enable the wireless communication device to be fed signals from a variety of sources.

Figure 4:
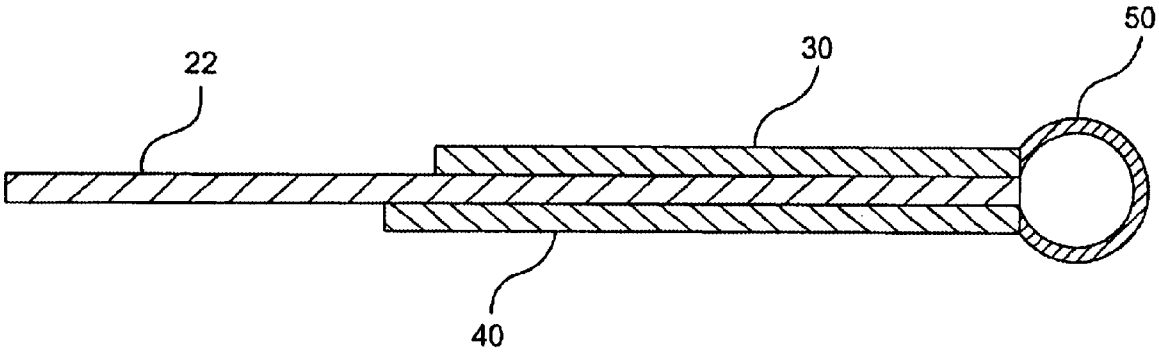
FIG. 4 is an elevational side view illustrating one embodiment of the present invention wherein at least one electrically conducting connecting link member electrically couples the first and the second conductive portions across opposing sides of a base member.

As depicted in FIG. 4, which is an elevational side view illustrating one embodiment of a ground plane constructed in accordance with the teaching of the present invention wherein at least one electrically conducting connecting link member 50 electrically couples the first conductive portion 30 and the second conductive portion 40 across opposing sides of a base member 22.

Figure 5:
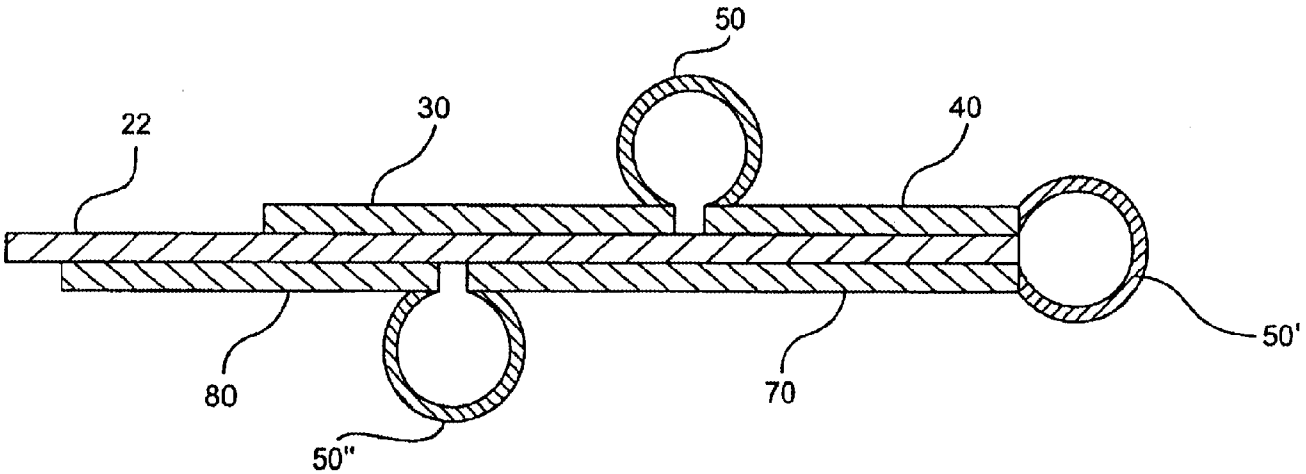
FIG. 5 depicts an embodiment of the present invention in an elevational side view wherein opposing sides of a printed wiring base member bear four discrete conductive portions electrically coupled by at least three electrically conducting connecting links.

As depicted in FIG. 5, which is an elevational side view illustrating an additional embodiment of a ground plane constructed in accordance with the teaching of the present invention wherein a plurality of electrically conducting connecting link members 50,50',50" electrically couples a first conductive portion 30, a second conductive portion 40, a third conductive portion 70, and a fourth conductive portion 80, respectively, across opposing sides of a single base member 22. Of course, while not specifically depicted herein, the base member 22 may comprise several discrete portions of a dielectric substrate member one or more of which may be formed of ceramic, composite, or resin-based electrically insulating material and the like. Furthermore, while the conducting members 50,50',50" appear in FIG. 5 as similar size and shaped members each of said members may be fabricated of different electrically conducting materials, having different dimensions and shapes, and may be aggregated so that more than one such member electrically couples a common set of two of said conductive portions (30, 40, 70, 80).

A benefit of the present invention is that it leads itself to conventional printed wiring board manufacturing techniques such as photo-lithography, deposition, etching, etc. Generally, the printed wiring board is a laminate having a nominal thickness of around 1.50 mm. While the preferred printed wiring board is formed from GETEK® (manufactured by the General Electric Company) it is understood that other laminate material having similar properties may be used. Alternatively, it is understood that the conductive portions may be provided by foils, films, moldings, or stampings or other conductive media suitable for antenna assemblies.

Multiband embodiments gain an additional advantage, where the inductive nature of the link enhances the electromagnetic wave patterns. Although particular embodiments have been described herein for convenience as being constructed using printed wiring board, no such limitation should be implied herein or applied to the teaching of the present invention.

Additional advantages and modifications will readily occur to those skilled in the art. The invention in its broader aspects therefore should not be limited to the specific details, representative apparatus and illustrative examples shown and described. Accordingly, any departure from such details may be made without departing from the spirit or scope of the general inventive concept herein described, taught, enabled, and illustrated, which limitations proceed from each of the following claims which are intended to cover every combination of elements as set forth hereinbelow.

What is claimed:

1. A ground plane assembly for use in an antenna assembly of a wireless communication device, the ground plane assembly comprising:

a first conductive portion;

a second conductive portion; and a conducting link element;

wherein the first conductive portion and the second conductive portion electrically couple via the conducting link element;

wherein the first conductive portion and second conductive portion and the conducting link element are combined to form a ground plane conductor and wherein the first conductive portion and the second conductive portion are co-planar.

2. The ground plane assembly of claim 1, wherein the first conductive portion and the second conductive portion are spaced apart.

3. The ground plane assembly of claim 1, wherein the first conductive portion is larger than the second conductive portion.

4. The ground plane assembly of claim 1, wherein the first conductive portion and the second conductive portion are generally quadrilateral.

5. The ground plane assembly of claim 1, wherein the conducting link element comprises a length of electrically conducting wire.

6. The ground plane assembly of claim 5, wherein the conducting link element has a predetermined axial length and the conducting link element is partially coiled.

7. The ground plane assembly of claim 1, wherein the conducting link element comprises a trace element of electrically conducting material disposed on a dielectric substrate member and wherein said dielectric substrate member also supports the first conductive portion and the second conductive portion.

8. The ground plane assembly of claim 1, further comprising a plurality of conducting link element members electrically coupling said first conductive portion and said second conductive portion.

9. An improved ground plane assembly for use with a wireless communication device of the type having an antenna assembly with a resonator, the improved ground plane comprising:

a first conductive portion; and a second conductive portion;

wherein the first conductive portion and the second conductive portion are operatively connected to each other by an electrically conducting link element;

wherein the first and second conductive portions and the conducting link element form a ground plane for a wireless communication device and wherein the first conductive portion and the second conductive portion are non-overlapping.

10. The ground plane assembly of claim 9, wherein the first conductive portion and the second conductive portion are spaced from each other.

11. The ground plane assembly of claim 9, wherein the first conductive portion is larger than the second conductive portion.

12. The ground plane assembly of claim 11, wherein the first conductive portion and the second conductive portion are substantially quadrilateral.

13. The ground plane assembly of claim 9, wherein the electrically conducting link element comprises a segment of electrically conducting wire.

14. The ground plane assembly of claim 9, wherein the electrically conducting link element comprises a trace element of electrically conducting material disposed on a dielectric substrate member and wherein said dielectric substrate member also supports the first conductive portion and the second conductive portion.

15. The ground plane assembly of claim 9, wherein the first conductive portion and the second conductive portion are shaped to substantially match the contours of an interior space of a wireless communication device.

16. The ground plane assembly of claim 9, further comprising:

a third conductive portion spaced from said second conductive portion; and, at least one additional conducting link element electrically coupling said second conductive portion and said third conductive portion.

17. The ground plane assembly of claim 9, further comprising a plurality of electrically conducting link element members electrically coupling said first conductive portion and said second conductive portion.

18. An antenna ground plane assembly comprising:

a dielectric substrate member;

a plurality of regions of conductive material disposed on the dielectric substrate member; and, at least one electrically conducting link member disposed between each of said plurality of regions of conductive material, and together the plurality of regions of conductive material and the at least one electrically conducting link member defining a contiguous ground plane for a wireless communications device.

* * * * *